United States Patent [19]

Meyer

[11] 4,336,775

[45] Jun. 29, 1982

[54] VALVE SELECTOR

[75] Inventor: Lawrence L. Meyer, Northville, Mich.

[73] Assignee: Eaton Corporation, Cleveland, Ohio

[21] Appl. No.: 117,705

[22] Filed: Feb. 1, 1980

Related U.S. Application Data

[63] Continuation of Ser. No. 640,132, Dec. 12, 1975, abandoned.

[51] Int. Cl.[3] ..... F02D 13/06

[52] U.S. Cl. ..... 123/198 F; 123/90.16; 123/90.32; 123/90.39

[58] Field of Search ..... 123/198 F, 90.15, 90.16, 123/90.27, 90.32, 90.39, 90.47

[56] References Cited

U.S. PATENT DOCUMENTS

| | | | |
|---|---|---|---|
| 2,019,252 | 10/1935 | Cottingham | 123/198 F |
| 2,023,048 | 12/1935 | Gentili | 123/90.16 |
| 2,394,738 | 2/1946 | Anthony | 123/198 F |
| 2,745,391 | 5/1956 | Winkler | 123/198 F |
| 2,851,023 | 9/1958 | Durkan | 123/90.16 |
| 3,179,094 | 4/1965 | Ribeton | 123/90.39 |
| 3,641,988 | 2/1972 | Torazza et al. | 123/90.27 |
| 4,050,435 | 9/1977 | Fullero et al. | 123/198 F |
| 4,064,861 | 12/1977 | Schulz | 123/198 F |

*Primary Examiner*—Ira S. Lazarus
*Attorney, Agent, or Firm*—C. H. Grace; P. S. Rulon

[57] ABSTRACT

A device for disabling a poppet valve in an internal combustion engine. The engine includes a valve actuating drive train having an overhead camshaft, a hydraulic lash adjuster, and a rocker arm which pivots at one end about the lash adjuster. The disabling device is secured to the valve stem and is drivingly interposed between the valve and the other end of the rocker arm. The disabling device includes a cap and drum or first drive means moveable with the rocker arm and relative to the valve stem, first and second springs concentric to the valve stem and respectively applying a biasing force to the first and second drive means, and a rotatable latch. The latch is moveable between a valve enabling position and a valve disabling position. The valve is enabled for normal opening and closing when the latch is in the valve enabling position; in this position the latch prevents relative movement between the first and second drive means and both springs bias the valve closed. The valve is disabled when the latch is in the valve disabling position; in this position the latch allows relative movement between the first and second drive means and the first spring biases the first drive means into contact with the rocker arm and the second spring biases the valve closed.

20 Claims, 4 Drawing Figures

VALVE SELECTOR

This is a continuation, of application Ser. No. 640,132, filed Dec. 12, 1975 now abandoned.

BACKGROUND OF THE INVENTION

1. Field of the Invention

The invention relates to a device for enabling and disabling a valve actuated by a rocker arm and more specifically to deactivating selected cylinders of an internal combustion engine by disabling the valves associated with the selected cylinders.

2. Description of the Prior Art

The concept of deactivating selected cylinders of an engine by disabling the valves associated with the selected cylinders is old. When this concept is applied to an Otto Cycle Engine, pumping or throttling losses are reduced, thereby improving engine efficiency during part throttle operation. Devices proposed in the prior art to carry out the concept have had some disadvantages, e.g. they were either expensive, unreliable, required extensive engine modifications, could not be switched on or off during engine operation, or caused clashing of components in the valve drive train due to the devices either physically separating valve train components or reducing forces tending to keep connecting components in driving contact.

SUMMARY OF THE INVENTION

An object of this invention is to provide a simple, low cost and reliable valve disabling device.

Another object of this invention is to provide the valve disabling device which is particularly suited for use in an engine of the overhead camshaft type.

According to a feature of this invention, the disabling device includes a drive means adapted to be drivingly interposed between one end of a rocker arm and a valve and a moveable means, which moveable means is operative in one position to enable the valve for normal opening and closing by preventing relative movement between the drive means and the valve and operative in another position to disable the valve by allowing relative movement between the drive means and the valve.

According to another feature of this invention, the disabler device includes first and second springs operative together to bias the valve closed when the device is in the valve enabling position and operative separately to bias the drive means into contact with the rocker arm and the valve closed when the device is in the valve disabling position; this feature has space and cost saving advantages since one of the two springs, that are needed for normal valve operation, may be used to bias the drive means into contact with the rocker arm, thereby preventing clashing of drive train components and/or ballooning of hydraulic means for preventing lash in the valve drive train.

BRIEF DESCRIPTION OF THE DRAWINGS

The preferred embodiment of the invention is shown in the accompanying drawings in which.

DETAILED DESCRIPTION OF THE DRAWINGS

Figure 1:
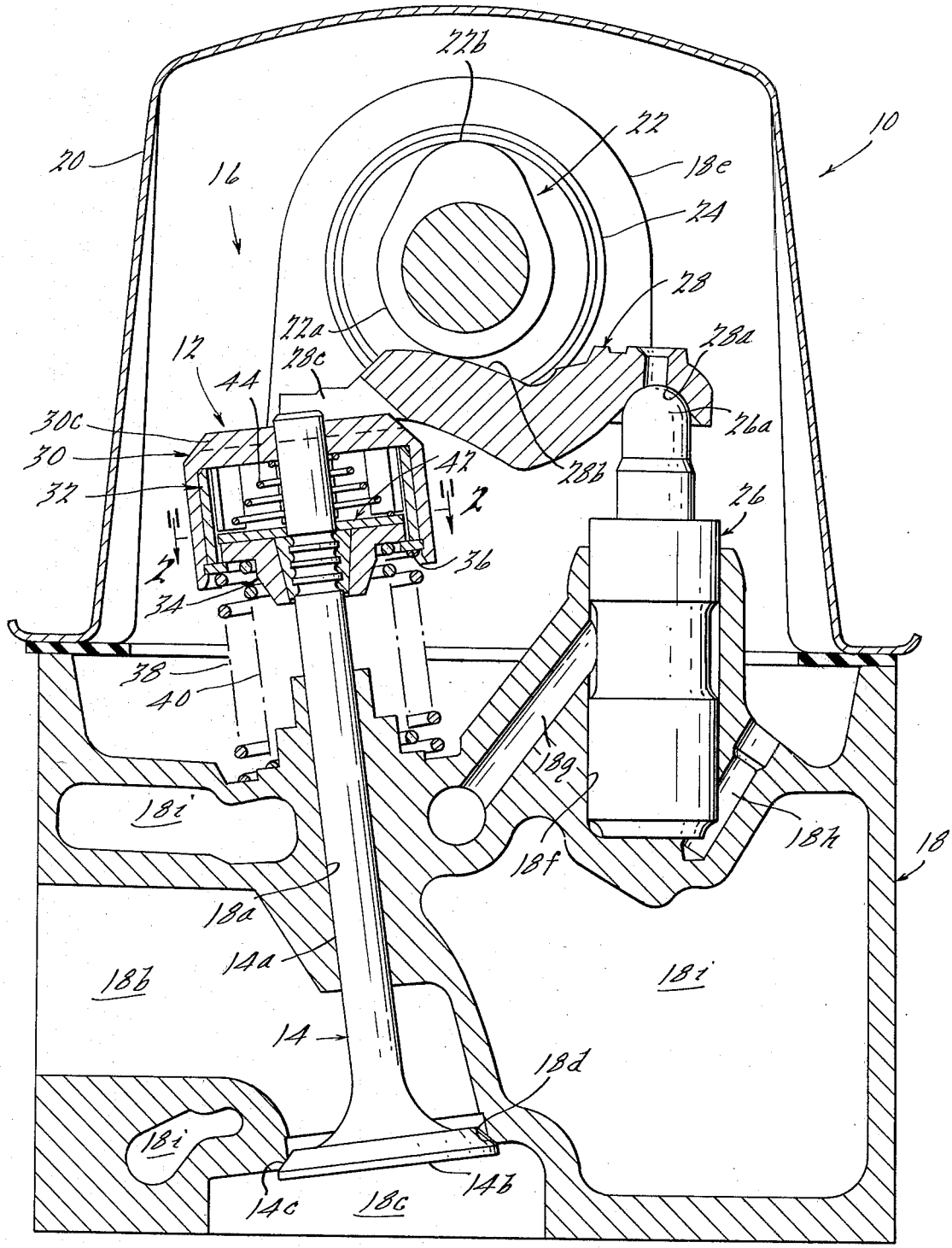
FIG. 1 is a sectional view of an internal combustion engine cylinder head embodying a valve disabling device.

Referring now to FIG. 1, therein is shown in cross-section an engine cylinder head assembly 10 of the overhead cam type. Cylinder head assembly 10 is adapted to embody a valve disabler device 12 of the present invention. The head assembly shown forms no part of the present invention and merely provides one example of the type of environment in which valve disabler device 12 may be embodied.

Head assembly 10 includes a valve 14, a valve drive train 16 for operating the valve, a cast head structure 18, and a sheet metal valve cover 20.

Valve 14 is of the poppet type having a stem portion **14*a* slideably disposed in a guide 18*a* defined by head structure 18 and a valve head portion 14*b*. Valve head portion 14*b* blocks the flow of gases between a passage 18*b* and a recess 18*c* when a tappered face 14*c* on the valve head rests on a valve seat 18*d* defined by the head structure. Recess 18*c*** opens into an unshown combustion chamber.

Valve drive train 16 is substantially conventional and includes a camshaft 22 journaled in a bearing 24 which is supported by an arched portion **18*e* defined by the head structure, a hydraulic lash adjuster 27 supported in a bore 18*f* defined by the head structure, and a rocker arm 28. Lash adjuster 26 includes a piston having a hemispherical end 26*a* seated in a mating socket 28*a* at one end of the rocker arm. Camshaft 22 includes a cam having a dwell portion 22*a* and a lift portion 22*b* which portions are in constant sliding contact with a midportion 28*b*** of the rocker arm.

Head structure 18 includes in addition to the above a passage **18*g* for supplying pressurized oil to the lash adjuster, a passage 18*h* for draining bore 18*f* and assisting in the installation of the adjuster, and three irregular shaped coolant passages 18*a***.

Disabler device 12 includes a cap 30, a locking drum 32, a retainer 34, a snap ring 36, a spring 38 reacting between the head structure and snap ring 36, a spring 40 in parallel with spring 38 and reacting between the head structure and retainer 34, a rotatable latch 42, and a cone shaped helical spring 44 for biasing latch 42 against retainer 34. Cap 30 and locking drum 32 form a first drive means. Retainer 34 forms a second drive means. Latch 42 is rotatable between a valve enabling position preventing a relative movement between the first and second drive means and valve disabling position allowing relative movement between the first and second drive means.

Figure 2:
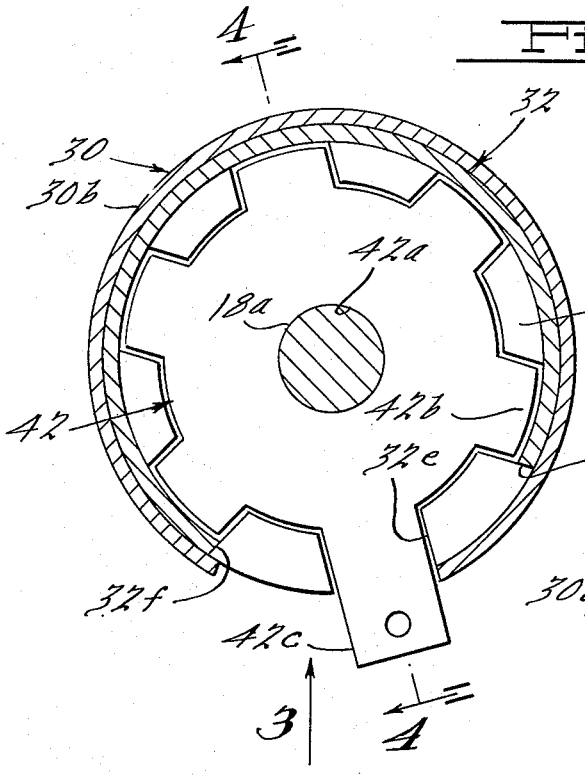
FIG. 2 is a sectional view of the disabler device looking along the line 2—2 of FIG. 1.
Figure 3:
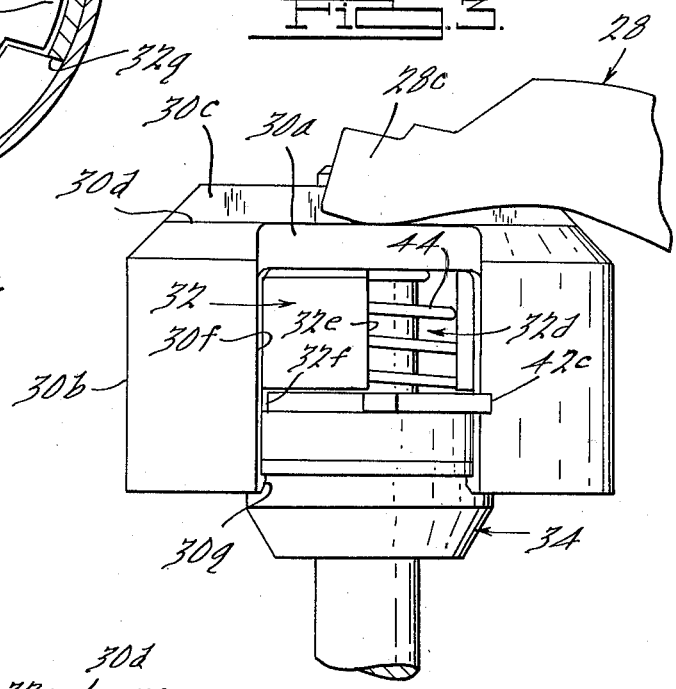
FIG. 3 is a view of the disabler device looking in the direction of arrow 3 of FIG. 2.
Figure 4:
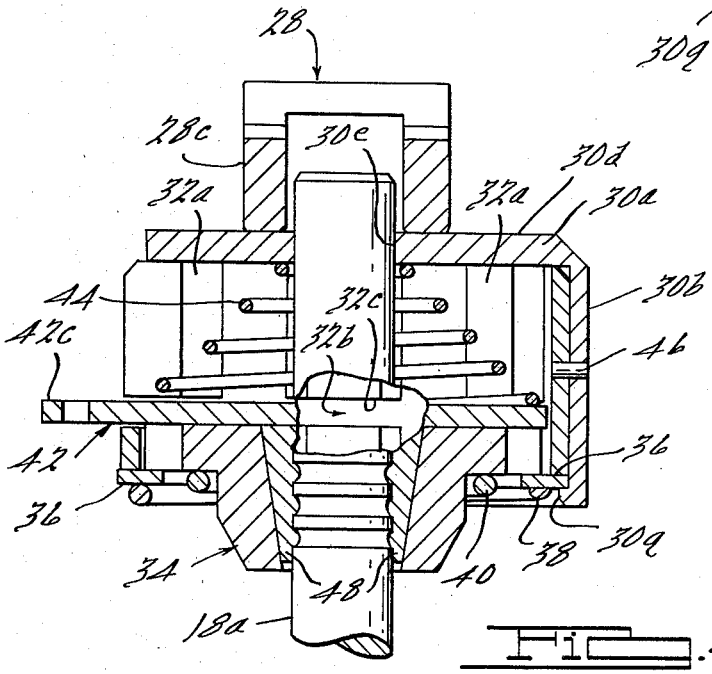
FIG. 4 is a sectional view of the disabler device looking along the line 4—4 of FIG. 2.

A more detailed description of disabler 12 is given with reference to FIGS. 2, 3, and 4. Cap 30 includes a top portion **30*a* and a cylindrical side wall portion 30*b*. Top portion 30*a* includes a rib 30*c* across the diameter of its upper surface 30*d* and an aperture 30*e* having a diameter equal to the width of the rib. Rib 30*c* receives a bifurcated end 28*c* of the rocker arm and retains the arm against lateral movement. Aperture 30*e* slideably receives the upper end of valve stem 18*a* and concentrically locates the cap with respect to the valve stem axis. Cylindrical wall 30*b* includes an opening or window 30*f* and a radially inwardly extending lip 30*g***.

Locking drum 32 fits snugly in cap 30 and includes a plurality of teeth or internal splines **32*a* extending substantially the length of the drum wall and parallel to its central axis, an annular groove 32***b* defined by an annular notch 32*c* in each spline 32*a*, and an inverted T shaped opening 32*d*. Opening 32*d* includes a vertical opening portion 32*e* having an arc width one half the number of degrees of the width of opening 30*f* in the cap and horizontal slots 32*f* and 32*g* which each have a width equal to the width of vertical opening 32*e*. A pin 46 retains the drum against rotation in the cap.

Retainer 34 functions as a valve spring retainer, as do conventional valve spring retainers, and as a support member of the valve disabler device. The retainer is secured to the valve stem by a pair of tapered keys 48 in a conventional manner. Retainer 34 includes a plurality of unshown teeth which slideably mate with splines 32*a*.

Snap ring 36 cooperates with lip 30*g* to hold the disabler device together and transmits the biasing force of spring 38 to the retainer and valve when the valve is open and when the cam dwell portion is in contact with the rocker arm.

The biasing force of spring 38 is great enough to prevent clashing of valve drive train components by maintaining cap 30 in contact with end 28*c* of the rocker arm and to prevent ballooning or over extending of the hydraulic lash adjuster. The biasing force of spring 40 is great enough to prevent opening of the valve due to suction pressures in recess 18*c*.

Rotatable latch 42 is disk shaped and includes a central aperture 42*a*, a plurality of teeth 42*b* disposed in annular groove 32*b* of the locking drum, and an actuating arm 42*c* provided by an extension of one of the teeth 42*b*. Aperture 42*a* is rotatably received by valve stem 18*a* which retains the latch against radial movement. Teeth 42*b* are substantially identical to the unshown teeth of retainer 34. Latch 42 is moveable from a valve disabling position, which disabling position is shown in FIG. 2, to a valve enabling position by rotating actuating arm 42*c* clockwise as viewed in FIG. 2. When the latch is in the valve disabling position splines 32*a* slide over the unshown teeth of retainer 34 and over teeth 42*b* in response to pivotal movement of the rocker arm, whereby spring 38 flexes in response to movement of the cap and locking drum. Spring 40 maintains valve 18 closed when the latch is in the valve disabling position. When the latch is in the valve enabling position teeth 42*b* are restrained in notches 32*c*, thereby preventing movement of the cap and locking drum relative to the latch and retainer and causing the valve to move in response to pivotal movement of the rocker arm.

In the disclosed embodiment, the position of locking drum 32 in cap 30 is such that vertical opening 32*e* and horizontal opening 32*f* align with opening 30*f* in the cap, and horizontal opening 32*g* is unused and covered by cylindrical side wall 30*b*. When the openings are so aligned, valve 18 is enabled by clockwise rotation of latch 42 and disabled by counterclockwise rotation of the latch. The direction of latch rotation for valve enablement and disablement may be reversed by positioning the locking drum in the cap so that horizontal opening 32*f* is covered by the cylindrical side wall thereby aligning vertical opening 32*e* and horizontal opening 32*g* with opening 30*f*.

Any of several well known types of actuators may be used to provide a force for rotating latch 42 from the valve enabling position to the valve disabling position. The force is preferably great enough to insure rapid rotation of the latch, but also low enough to be ineffective when the valve is open, i.e., the force is ineffective to overcome the friction between teeth 42*b* and notches 36*c* when the cam is moving the disabling device and the valve as a unit.

A preferred embodiment of the invention has been disclosed for illustrative purposes. Many variations and modifications of the preferred embodiment are believed to be within the spirit of the invention. The following claims are intended to cover the inventive portions of the preferred embodiment and variations and modifications believed to be within the spirit of the invention.

What is claimed is:

1. In a machine having a valve disabling device selectively operative to disable a valve which is normally opened and closed in response to pivotal movement of a rocker arm, said disabling device comprising:

drive means installed intermediate one end of said rocker arm and said valve and in driving contact with said one end of said rocker arm; and means moveable from a valve enabling position preventing relative movement between said drive means and said valve for enabling said valve for normal opening and closing and moveable to a valve disabling position allowing relative movement between said drive means and said valve for disabling said valve.

2. The disabling device of claim 1, further including:

means for biasing said drive means toward said one end of said rocker arm and for biasing said valve to the closed position.

3. The disabling device of claim 1, further including:

first biasing means for biasing said drive means toward said one end of said rocker arm; and second biasing means for biasing said valve closed and operative to also bias said drive means toward said one end of said rocker arm when said moveable means is in said valve enabling position.

4. The disabling device of claim 3, wherein said first and second biasing means operate in a parallel relation to bias said valve toward the closed position when said moveable means is in said valve enabling position.

5. The disabling device of claim 1, further including:

first and second biasing means arranged in parallel relation, said first and second biasing means operative to bias said drive means towards said one end of said rocker arm and said valve toward the closed position when said moveable means is in said valve enabling position, said first biasing means operative to yieldably oppose movement of said drive means relative to said valve independent of said second biasing means when said moveable means is in said valve disabling position, and said second biasing means operative to bias said valve toward the closed position independent of said first biasing means when said moveable means is in said valve disabling position.

6. In a machine having a valve disabling device selectively operative to disable a valve which is normally opened and closed in response to pivotal movement of a rocker arm, said disabling device comprising:

means installed intermediate one end of said rocker arm and said valve and including first drive means in driving contact with said one end of said rocker arm and second drive means secured to said valve;

first resilient means for biasing said first drive means towards said one end of said rocker arm;

second resilient means reacting against said second drive means and operative to bias said valve toward the closed position; and latch means moveable from a valve enabling position preventing relative movement between said first and second drive means for enabling said valve for normal opening and closing and moveable to a valve disabling position allowing relative movement between said first and second drive means for disabling said valve.

7. The disabling device of claim 6, wherein said first drive means includes a set of teeth slideably mating with a set of teeth defined by said second drive means and wherein said latch means includes:

means operative to prevent sliding movement of said teeth relative to each other when said latch means is in said valve enabling position and to allow sliding movement of the teeth relative to each other when said latch means is in said valve disabling position.

8. The disabling device of claim 6, wherein said first and second resilient means operate in parallel to bias said valve to the closed position when said latch means is in said valve enabling position.

9. An improved valve disabling device in an internal combustion engine of the type having a valve drive train including a cam on a camshaft and a rocker arm which normally opens and closes the valve in response to the cam causing pivotal movement of the rocker arm, said device comprising:

means drivingly interposed between one end of said rocker arm and said valve and including drive means in contact with said one end of said rocker arm; and means moveable from a valve enabling position preventing relative movement between said drive means and said valve for enabling said valve for normal opening and closing and moveable to a valve disabling position allowing relative movement between said drive means and said valve for disabling said valve.

10. The device of claim 9, further including:

resilient means for biasing said drive means towards said one end of said rocker arm with a force operative to maintain said drive means in contact with said one end of said rocker arm.

11. The engine of claim 9, further including hydraulic means for preventing lash in said valve drive train and wherein said device further includes:

resilient means for biasing said first means towards said one end of said rocker arm with a force sufficient to prevent ballooning of said hydraulic means.

12. The disabling device of claim 9, further including: means for biasing said drive means toward said one end of said rocker arm and for biasing said valve to the closed position.

13. The disabling device of claim 9, further including:

first resilient means for biasing said first means toward said one end of said rocker arm; and second resilient means for biasing said valve closed and operative to also bias said first means toward said one end of said rocker arm when said moveable means is in said valve enabling position.

14. The disabling device of claim 13, wherein said first and second resilient means operate in a parallel relation to bias said valve toward the closed position when said moveable means is in said valve enabling position.

15. The disabling device of claim 9, further including:

first and second resilient means arranged in parallel relation, said first and second resilient means operative to bias said fist means towards said one end of said rocker arm and said valve toward the closed position when said moveable means is in said valve enabling position, said first resilient means operative to yieldably oppose movement of said first drive means relative to said valve independent of said second resilient means when said moveable means is in said valve disabling position, and said second resilient means operative to bias said valve toward the closed position independent of said first resilient means when said moveable means is in said valve disabling position.

16. An improved valve disabling device in an internal combustion engine of the type having a valve drive train including a cam on a camshaft and a rocker arm which normally opens and closes the valve in response to the cam causing pivotal movement of the rocker arm, said device comprising:

means driving interposed between one end of said rocker arm and said valve and including first drive means in driving contact with said one end of said rocker arm and second drive means secured to said valve;

first resilient means for biasing said first drive means towards said one end of said rocker arm;

second resilient means reacting against said second means and operative to bias said valve toward the closed position; and latch means moveable from a valve enabling position preventing relative movement between said first and second drive means for enabling said valve for normal opening and closing and moveable to a valve disabling position allowing relative movement between said first and second drive means for disabling said valve.

17. The device of claim 16, wherein resilient means biases said first means towards said one end of said rocker arm with a force sufficient to maintain said first drive means in contact with said one end of said rocker arm.

18. The engine of claim 16, further including hydraulic means for preventing lash in said valve drive train and wherein said device further includes:

resilient means for biasing said first means towards said one end of said rocker arm with a force sufficient to prevent ballooning of said hydraulic means.

19. The disabling device of claim 16, wherein said first means includes a set of teeth slideably mating with a set of teeth defined by said second means and wherein said latch means includes:

means operative to prevent sliding movement of said teeth relative to each other when said latch means is in said valve enabling position and operative to allow sliding movement of the teeth relative to each other when said latch means is in said valve disabling position.

20. The disabling device of claim 16, wherein said first and second resilient means operate in parallel to bias said valve to the closed position when said latch means is in said valve enabling position.

* * * * *